US005592976A

United States Patent [19]

Zwiener

[11] Patent Number: 5,592,976

[45] Date of Patent: Jan. 14, 1997

[54] THREAD BREAKING DEVICE FOR A POWER LOOM

[75] Inventor: Rudolf Zwiener, Arbon, Switzerland

[73] Assignee: Saurer Sticksysteme AG, Arbon, Switzerland

[21] Appl. No.: 567,079

[22] Filed: Dec. 4, 1995

[51] Int. Cl.[6] ..... B65H 59/26; D03D 47/34

[52] U.S. Cl. ..... 139/194; 139/450; 242/419.7

[58] Field of Search ..... 139/452, 450, 139/194; 242/47.01, 419.7

[56] References Cited

U.S. PATENT DOCUMENTS

| | | | |
|---|---|---|---|
| 3,464,458 | 9/1969 | Svaty | 139/450 |
| 3,633,711 | 1/1972 | Pfarrwaler | 139/450 |

FOREIGN PATENT DOCUMENTS

| | | | |
|---|---|---|---|
| 0527510 | 2/1993 | European Pat. Off. | 242/419.7 |

*Primary Examiner*—Andy Falik
*Attorney, Agent, or Firm*— Dority & Manning

[57] ABSTRACT

A weft yarn break for a power loom has first and second sets of hoops. Each set of hoops has at least two hoops which are spaced apart and essentially parallel to each other. A mechanism drives at least one of the sets of hoops about a rotational axis so that the first and second set of hoops have a relative swivelling, motion. A transversing hoop is disposed in the running direction of the weft yarn and includes an inclined surface located across the running path or direction of the weft yarn. The weft yarn is shifted up and down the inclined run-up surface as the first and second set of hoops are swivelled relative to each other.

8 Claims, 5 Drawing Sheets

THREAD BREAKING DEVICE FOR A POWER LOOM

DESCRIPTION OF PRIOR ART

The object of this invention is a weft yarn brake for a power loom. The invention relates to weft yarn brakes for air looms as well as to weft yarn brakes for rapier looms or for any other kind of power loom.

The installation of at least one weft yarn brake, in the form of a loop brake on the weft insertion side of a power loom is known.

Such a loop brake consists of one or several fixed yarn hoops along which the weft yarn runs, and of one or several yarn rakes driven rotatably between the yarn hoops, whereby the yarn rake is in turn provided with one or several hoops along which weft yarns also run.

Swiveling/shifting of the hoops of the yarn rake relative to the fixed yarn hoops causes the weft yarn to be looped more or less around the individual cross-sections of the hoops in order to produce a braking effect in that manner.

With such looping brakes it has been shown to be a disadvantage that the weft yarn always runs along one and the same point of the fixed and of the mobile hoops of the weft yarn brake, as this causes greater wear. The weft yarn tends to cut into or run into the sections of the weft yarn brake which it touches. Even hardening of the sections of the weft yarn brake which are in contact with the yarn has not shown the needed results over longer periods of time. As the weft yarn cuts increasingly into the surface of the weft yarn brake coming into contact with the yarn, the weft yarn is also continuously damaged and this may lead to yarn breakage.

Thus, as operating time of the weft yarn brake increases, the weft yarn cuts into the parts of the weft yarn brake with which it comes into contact, and this leads to increased deterioration of the quality of the weft yarn and to damage of the parts coming into contact with the yarn.

OBJECT OF THE INVENTION

The invention has therefore as a principal object to perfect a weft yarn brake in the form of a loop brake in such manner as to ensure considerably longer life of the brake.

It is an additional object of the invention to prevent the deterioration of quality through continued picking of the weft yarn at the weft yarn brake.

SUMMARY OF THE INVENTION

In order to attain the objects of the invention, the invention provides a weft yarn brake for a power loom comprising at least a first set of two hoops which are substantially parallel and at a distance from each other, at least two additional hoops which are substantially parallel and at a distance from each other, whereby the hoops of the first and the second set of hoops can swivel around an axis relative to each other and whereby a weft yarn loops at least partially around these first and second sets of hoops, this looping being dependent on the degree of rotation of these first and second sets of hoops relative to each other, and furthermore comprising at least two traversing hoops with run-up surfaces for the weft yarn that are at an angle to this axis of rotation as compared with a vertical, so that when the first and second set of hoops are swivelled relative to each other, the weft yarn is shifted in the direction of the axis of rotation against these run-up surfaces.

This ensures that always different portions of the weft yarn brake are touched by the weft yarn as a result of the level adjustment of the weft yarn running through the weft yarn brake.

In a preferred embodiment of this invention a level or vertical height adjustment, of the weft yarn of up to 5 mm with respect to a vertical plane through the rotational axis of the hoops is possible in the yarn rake. This means the weft yarn is displaced in the weft yarn brake against the fixed as well as against the moving parts of said weft yarn brake within a level range of up to 5 mm.

Due to the oscillating rotation drive of the yarn rake in the weft yarn brake, an oscillating shift of the weft yarn, parallel to the axis of rotation of the yarn rake in the weft yarn brake occurs accordingly. The elementary frequency of the level shift of the weft yarn corresponds here to the elementary frequency of the oscillation of the yarn rake in the weft yarn brake.

The invention is not limited to one single weft yarn being taken through the weft yarn brake, and several weft yarns running parallel to each other can also be introduced into the weft yarn brake and can thus be braked.

In a preferred embodiment of the invention both the intake and the exit sides of the weft yarn brake are provided with traversing hoops which execute the previously mentioned level shift of-the weft yarn (parallel to the axis of rotation of the yarn rake).

It is preferable here for the traversing hoop to be made of a round profile (e.g. a round wire) and for the round wire to have a diameter of e.g. 4 mm. Instead of a round wire, other yarn-repelling surfaces can of course also be used, such as e.g. a rectangular profile which is curved suitably in order to constitute a yarn repelling surface that rises at an angle, an extruded plastic part made in one or several pieces with the other parts of the yarn rake, a ceramic part, etc.

It is important for each traversing hoop to be provided with at least one yarn-guiding surface in the form of a run-up surface which is at an angle to the direction of yarn movement.

When a weft yarn runs for approximately 400 mm through the weft yarn brake according to the invention, the yarn rake of the weft yarn brake swivels (closes) each time, and during that time the weft yarn is lifted from its lower point of passage in the yarn rake to its upper point of passage in the yarn rake. With an incline of approximately 40° of the run-up surface of the traversing hoop, the earlier-mentioned level adjustment of 5 mm is reached, so that the weft yarn is lifted from its lowest to its upper passage position. With a flat run-up surface the shift of the weft yarn in the weft yarn brake would be accordingly smaller, e.g. only for a level change of e.g. 2–3 mm. These are values gained from experience which have proven to be advantageous.

BRIEF DESCRIPTION OF THE DRAWINGS

The invention is explained in further detail through the enclosed drawings.

DESCRIPTION OF A PREFERRED EMBODIMENT

Figure 1:
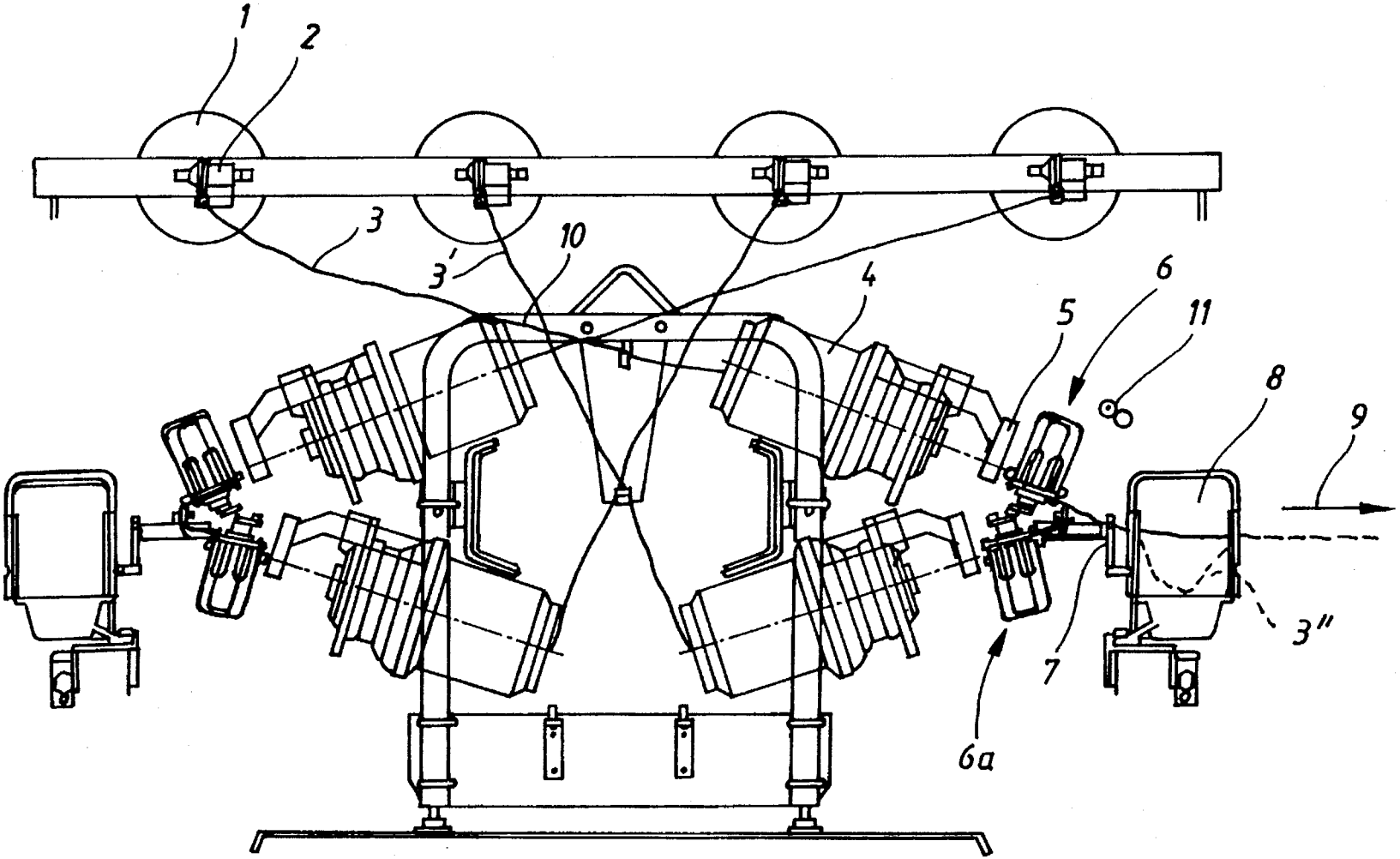
FIG. 1 shows a side view of the weft insertion side of a power loom.
Figure 2:
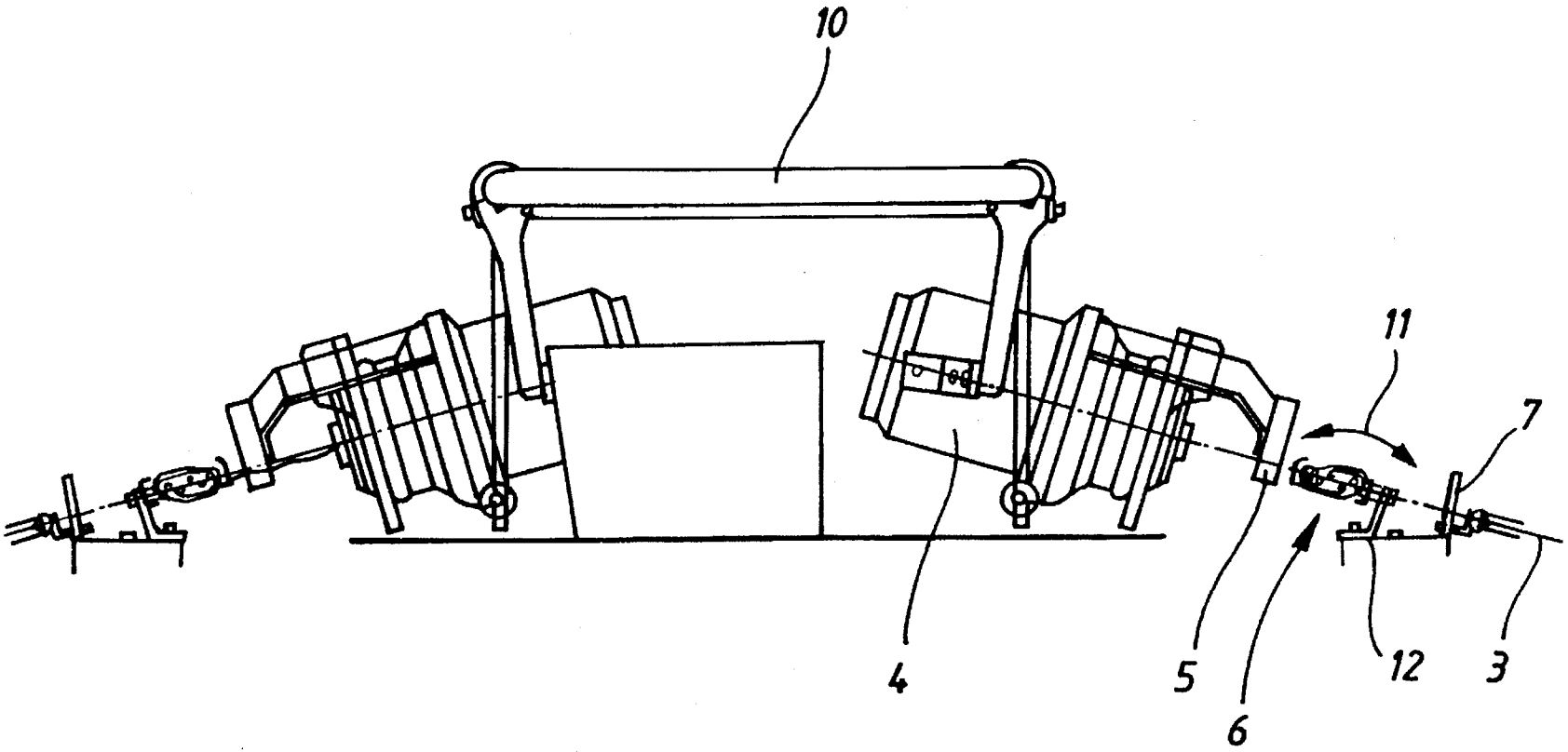
FIG. 2 is a top view of the arrangement according to FIG. 1.

According to FIGS. 1 and 2, one or more cross-wound bobbins 1 are located on the weft yarn insertion side of a power loom, each bobbin being assigned a pre-brake 2.

One or more pre-winding devices 4 are installed on a common carrier 10, and through each pre-winding device runs a corresponding yarn 3, 3' which is being unwound from a cross-wound bobbin 1 assigned to it. A weft yarn brake 6, **6*a* is provided here for each yarn or weft yarn 3, 3'**.

In the following representation the function of one single yarn and of one appertaining weft yarn brake 6 is explained although, as can be recognized from FIG. 1, each yarn 3 is assigned its own weft yarn brake 6 and its own pre-winding device. The weft yarn brakes 6 are essentially identical for every yarn 3, 3'.

The weft yarn brake 6 is adjacent a yarn sensor 5 of the pre-winding device 4, as seen in run-up direction, and in front of an additional yarn guide 7 as seen in the insertion direction, said yarn guide 7 being upstream of a yarn pocket 8. The weft yarn 3,3' is taken from the yarn pocket 8 in the direction of arrow 9 and is introduced by drive means which are not further shown into the shed of the power loom.

Figure 3:
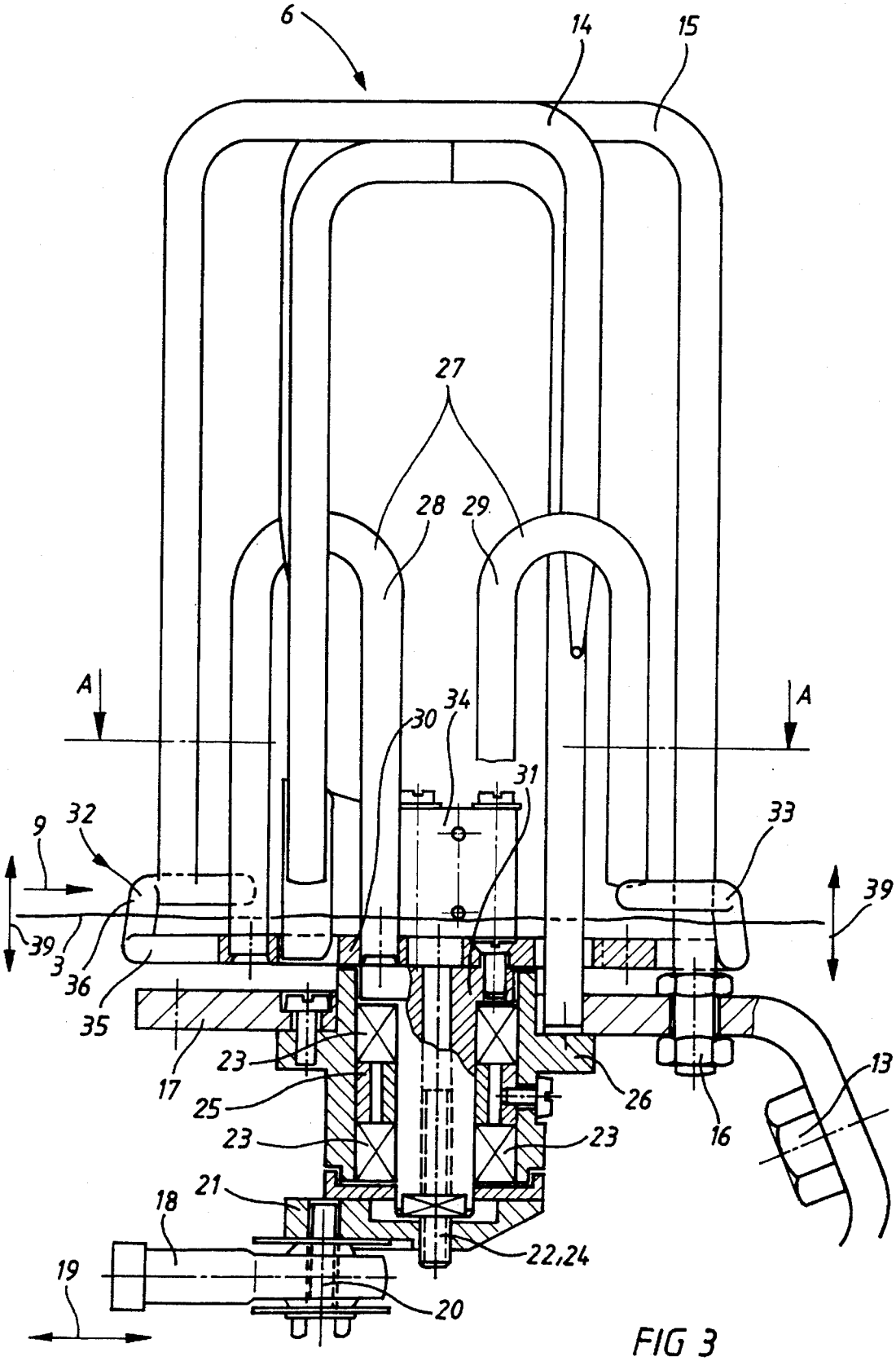
FIG. 3 is a side view and partial section through a weft yarn brake according to the invention.

The weft yarn brakes. 6, **6*a* are located on a fixed support 12 as shown in FIGS. 2 and 3. The support 12 is curved in the approximate shape of an U and is attached to the power loom itself by means of a nut 13 welded to the support and a screw on the power loom itself. The support 12 merges into a flat iron piece 17 which supports the weft yarn brake 6**.

The flat iron bar 17 has a central seat in which a bearing bushing 26 is fixedly mounted by means of screws.

Figure 4:
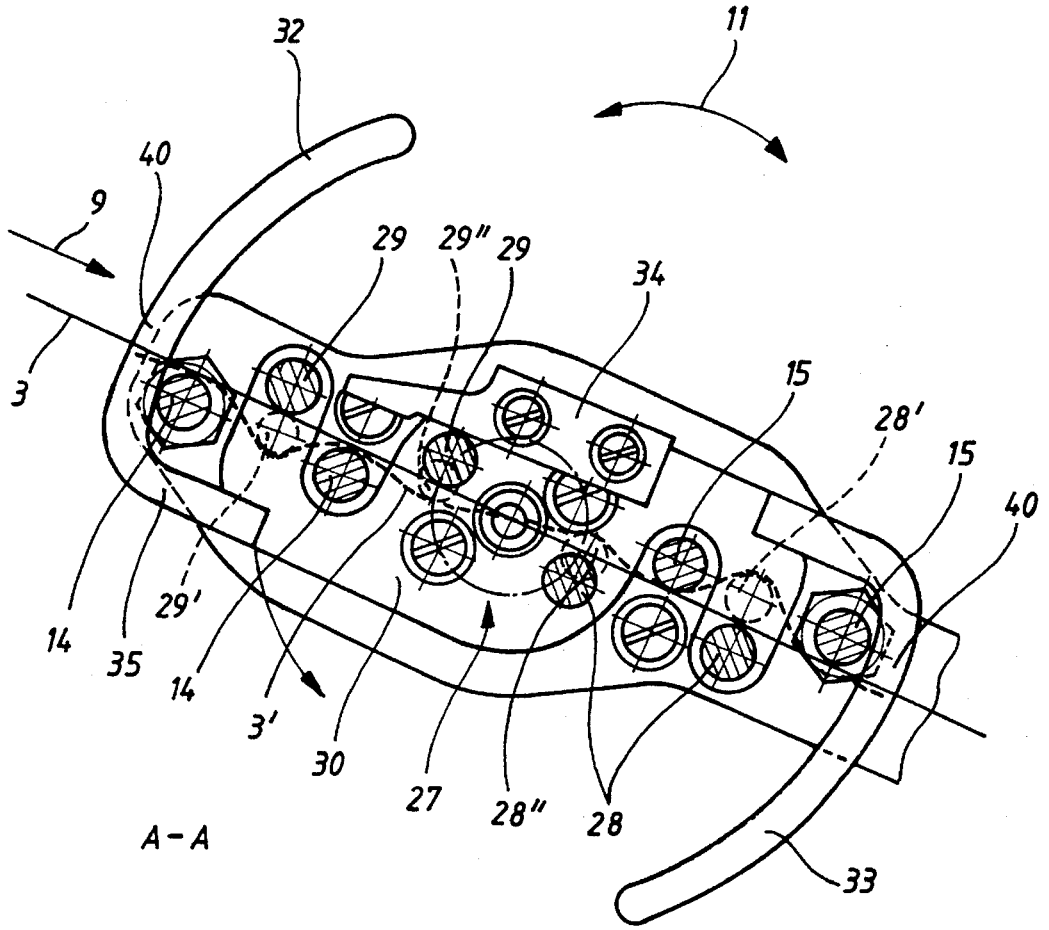
FIG. 4 is a top view of the arrangement acceding to FIG. 3.

The flat iron bar is provided with upper and lower ball bearings 23 on the inside which rotatably support a collar bolt 31 which is driven rotatably in the direction of arrow 11 (see also FIG. 4). The driving action takes place here via a drive shaft 18 at which an oscillating drive which is not further shown is connected, said drive shaft 18 being driven back and forth (in the direction of its longitudinal axis) in the direction of arrow 19. The forward end of the drive shaft 18 is held in a pivot bearing 20 which is connected at the free, swivelling end of a lever 21 which is non-rotatably connected to a screw 24, said screw being in turn non-rotatably connected to the collar bolt 31.

The screw 24 therefore constitutes the rotational axis 22 for the rotational movement of collar bolt 31 in the direction of arrow 11.

It should be added that the pivot bearing of the yarn rake 27 is also provided with a bushing 25 which is non-rotatably connected to the outer bearing bushing 26 and at the upper side and underside of which the previously mentioned ball bearings 23 are installed.

The collar bolt 31 is in turn connected non-rotatably to a plate 30 on which the yarn rake 27 is attached. The yarn rake 27 consists of two parallel hoops 28, 29 at a distance from each other provided with surfaces that are in contact with the weft yarn 3.

On the other hand additional parallel yarn hoops 14,15 are installed on the support 12 at a distance from each other and are attached by means of nuts 16. The yarn hoops 14,15 are also provided with surfaces coming into contact with weft yarn.

From FIG. 4 it can be seen that the yarn rake 27 with the hoops 28,29 attached to it moves back and forth between the fixed yarn hoops 14, 15 (direction of arrow 11) in order to provide thus for a looping brake for the passing weft yarn 3 which runs through in the direction of arrow 9.

The hoops 28,29 as well as the yarn hoops 14,15 are preferably formed of a round-profile wire, but instead of a round-profile wire it is also possible to use an oval-profile wire.

It is now important that a traversing hoop 32,33 be installed as shown in FIG. 4 on the intake side and on the output side of the weft yarn brake, said traversing hoop being provided with run-up surfaces 40 to be in contact with the weft yarn and ensuring that said weft yarn is displaced in its level, i.e. in the direction 39 (FIG. 3) of the rotational axis 22.

FIG. 4 shows here two different rotational positions of the yarn rake 27 which is driven by the previously mentioned drive as it oscillates in the arrow directions 11.

In one rotational position (position of release of the weft yarn brake) the weft yarn 3 runs practically without friction or with only minimal friction between the different hoops, as shown in FIG. 4.

If however the yarn rake 27 is rotated counterclockwise as shown in FIG. 4, the portion of hoop 29 closest to the inserting side of the weft yarn is swivelled into its position 29', while the portion of hoop 29 further away from the insertion side is swivelled into its position 29".

It can be seen here that the weft yarn (represented by a broken line) is still running along hoop 29, but is taken also around the fixed yarn hoop 14 in a larger loop.

The same conditions also apply to the run-up side of the weft yarn brake, where it can be seen that the movable portion of the hoop 28" is shifted into its position 28' or 28'.

This results in a stronger looping at the above-mentioned portions of the weft yarn brake which come into contact with the yarn, so that a strong braking effect takes place.

In this situation the weft yarn tends to cut or dig into the parts in contact with the yarn, i.e. into hoops 14, 15 as well as into hoops 28,29, and this is avoided by the arrangement of the traversing hoops 32,33 according to the invention.

For this purpose a traversing hoop 32,33 which defines run-up surfaces 40 in the perpendicular direction to the course of the weft yarn is installed at the intake as well as the outlet side of the weft yarn brake on the yarn rake.

Each traversing hoop in this case consists of a lower, horizontal part 35 which is connected to the plate 30.

This horizontal part 35 merges into the also horizontal part 36 from which the run-up curve 37 extends at an angle upward.

Figure 5:
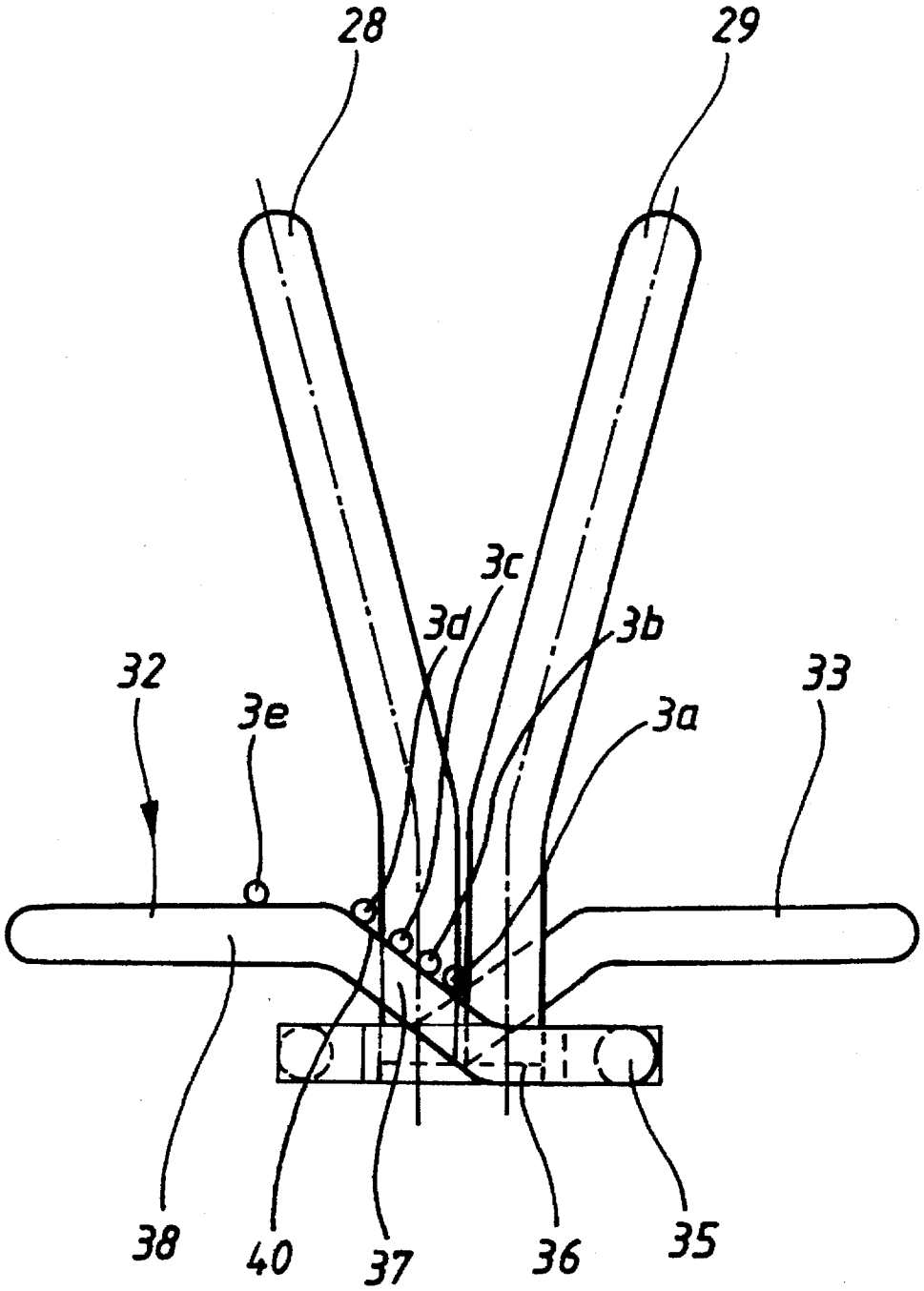
FIG. 5 is a side view of the yarn rake of a weft yarn brake according to FIGS. 3 and 4.

It is preferable here to provide for the angle of the run-up curve 37 to be within a range of 15° and 60° relative to the horizontal, as seen in FIG. 5.

It can be seen in FIG. 5 that the weft yarn 3 assumes different positions on the run-up surface 40, depending on the rotation of the yarn rake 27 in the arrow directions 11. The weft yarn is represented here by the letters **3*a,b,c,d,e* in different positions on the traversing hoop 32**.

Thanks to the arrangement of the run-up surface it can therefore be seen that the weft yarn no longer touches one and the same part of the yarn hoops 14,15 or 28,29, but that it is shifted up and down along the circumferences of these hoops, depending on the rotational position assumed by the yarn rake 27 in the arrow directions 11.

The cutting or digging of the weft yarn into the corresponding locations of the weft yarn brake in contact with the yarn is thereby avoided completely, because every surface of the weft yarn brake is touched only briefly by the weft yarn, and because the weft yarn is then moved up and down over this surface.

FIG. 3 shows this capability of level adjustment of the weft yarn, as shown in arrow direction 39, and it can be seen that the weft yarn is moved up and down in this arrow direction.

The traversing hoop 32,33 merges furthermore into an upper, slightly inclined part 38 against which the weft yarn also comes to lie in its position 3*e*, as seen in FIG. 5.

In a level change action of the weft yarn in the arrow direction 39, over a distance of 4 mm, the length of the run-up surface 40 is approximately 10 mm and the length of the following slightly inclined part 38 is approximately 8 mm.

This ensures that a safety clearance still exists when the weft yarn 3,3' lies in its position 3*e* on the horizontal part 38, so that the yarn cannot drop off from the horizontal part 38.

In a further development of the present invention, a yarn stopper 34 is installed on the rotatable part, i.e. of the yarn rake 27 of the weft yarn brake, to ensure that when the power loom is stopped, the weft yarn is held in the yarn brake.

With the new invention, i.e. with the arrangement of traversing hoops at the yarn rake of the weft yarn brake, the stoppage time of such a weft yarn brake has become considerably longer. By comparison with conventional weft yarn brakes, the stoppage time of the weft yarn brake according to the invention is increased manyfold.

In addition, it is no longer necessary to harden or temper the surfaces of the weft yarn brake in contact to the extent necessary previously, so that this also provides the advantage that the weft yarn brakes according to the invention can be produced at much lower cost.

It will be evident that there are numerous embodiments of the present invention which, not specifically described above, are clearly within the scope and spirit of the invention. Consequently, the above description is considered to be exemplary only and the full scope of the invention is to be determined solely by the appended claims.

I claim:

1. A weft yarn brake for a power loom, said brake comprising:

a first set of hoops including at least two hoops spaced apart and essentially parallel to each other;

a second set of hoops including at least two hoops spaced apart and essentially parallel to each other;

a mechanism including a drive device to swivel at least one of said first and second set of hoops about a rotational axis so that a relative swivelling motion is generated between said first and second set of hoops, wherein a weft yarn that is looped around said first and second set of hoops in a running direction through said yarn brake is braked by said relative swivelling motion of said first and second set of hoops; and at least one traversing hoop disposed in said running direction of the weft yarn, said traversing hoop further comprising a run-up surface transverse to said running direction of the weft yarn, said run-up surface inclined relative to the running direction of the weft yarn wherein the weft yarn is shifted up and down said inclined run-up surface as said first and second sets of hoops are swivelled relative to each other.

2. The yarn brake as in claim 1, wherein said first set of hoops is rotationally driven by said drive device around said rotational axis, and said second set of hoops is rotationally stationary.

3. The yarn brake as in claim 1, wherein said inclined run-up surface comprises an angle generally within a range of between fifteen degrees and sixty degrees with respect to horizontal.

4. The yarn brake as in claim 3, wherein said angle is approximately forty degrees.

5. The yarn brake as in claim 1, further including at least one additional traversing hoop, one of said traversing hoops disposed operably before said first and second set of hoops in said running direction of the weft yarn and said other traversing hoop disposed operably after said first and second set of hoops in said running direction of the weft yarn.

6. The yarn brake as in claim 1, wherein said first and second set of hoops and said traversing hoop comprise hardened contact surfaces which contact the weft yarn in its running direction through said yarn brake.

7. The yarn brake as in claim 1, wherein said yarn brake is configured for receipt of a plurality of weft yarns therethrough.

8. The yarn brake as in claim 1, wherein the weft yarn changes height up to about 5 mm with respect to a vertical plane through said rotational axis as it moves along said inclined run-up surface of said traversing hoop.

* * * * *